US006050340A

United States Patent [19]

Scott

[11] Patent Number: 6,050,340

[45] Date of Patent: Apr. 18, 2000

[54] DOWNHOLE PUMP INSTALLATION/ REMOVAL SYSTEM AND METHOD

[75] Inventor: Matthew T. Scott, Austin, Tex.

[73] Assignee: Weatherford International, Inc., Houston, Tex.

[21] Appl. No.: 09/049,826

[22] Filed: Mar. 27, 1998

[51] Int. Cl.[7] ..... E21B 23/00; E21B 34/14

[52] U.S. Cl. ..... 166/373; 166/386; 166/68; 166/105

[58] Field of Search ..... 166/373, 382, 166/386, 68, 105, 109, 332.7, 372, 105.6

[56] References Cited

U.S. PATENT DOCUMENTS

| | | | |
|---|---|---|---|
| 1,355,606 | 10/1920 | Ingram . | |
| 1,758,376 | 5/1930 | Sawyer . | |
| 2,287,076 | 6/1942 | Zachry . | |
| 2,826,994 | 3/1958 | Slater . | |
| 3,215,087 | 11/1965 | McLeod, Jr. . | |
| 3,887,008 | 6/1975 | Canfield . | |
| 4,183,722 | 1/1980 | Roeder . | |
| 4,293,283 | 10/1981 | Roeder . | |
| 4,390,061 | 6/1983 | Short . | |
| 4,603,735 | 8/1986 | Black . | |
| 4,790,376 | 12/1988 | Weeks . | |
| 5,018,581 | 5/1991 | Hall . | |
| 5,083,609 | 1/1992 | Coleman . | |
| 5,316,084 | 5/1994 | Murray et al. | 166/386 |
| 5,372,190 | 12/1994 | Coleman | 166/68 |
| 5,507,349 | 4/1996 | Wray et al. | 166/382 |
| 5,651,664 | 7/1997 | Hinds et al. | 166/105.6 |

*Primary Examiner*—William Neuder
*Attorney, Agent, or Firm*—Browning Bushman

[57] ABSTRACT

Installation/removal assembly and method are disclosed that reduce forces required for installing and removing from a wellbore hydraulic artificial lift installations, such as, for example, hydraulic reciprocating pumps, hydraulic jet pumps, coil tubing hydraulic jet pumps, and other hydraulically operated installations. The installation/removal assembly is provided with a hydraulically activated latch and spear assembly that, in a preferred embodiment, includes no radially extending latch elements for securing a bottomhole assembly to a reservoir connection, such as a seating nipple designed for use with mechanical latches. A bottomhole assembly is provided with relatively moveable inner and outer members that move between closed and open positions for respectively sealing or equalizing, differential pressure across a one-way valve that arises when the pump is turned off. The pressure above the one-way valve may be the same as the annulus pressure between the production tubing and the bottomhole assembly of the hydraulic artificial lift installation. External communication embodiments of the present invention communicate directly to the annulus between the production tubing and the bottomhole assembly of the artificial hydraulic lift installation. Internal communication embodiments of the present invention communicate internally of the outer member through the pump output port to the annulus to avoid debris that may exist in the annulus below a pump discharge port.

36 Claims, 8 Drawing Sheets

DOWNHOLE PUMP INSTALLATION/ REMOVAL SYSTEM AND METHOD

BACKGROUND OF THE INVENTION

1. Field of the Invention

The present invention relates generally to any form of hydraulic artificial lift technique including hydraulic reciprocating pumps, hydraulic jet pumps, and hydraulic coiled tubing jet pump installation and removal and, more particularly, to apparatus and methods for facilitating downhole connection, sealing, and disconnection thereof.

2. Description of the Background

While high-pressure oil formations have sufficient pressure to push production fluid to the surface, low-pressure formations typically require a downhole pump to lift the oil to the surface. Downhole pumps are of numerous types and include such pumps as sucker-rod-type reciprocating pumps as well as hydraulic-artificial-lift-type coil tubing jet pumps. The selection of the type of pump to be used depends on the particulars of the oil field. One of the big advantages of coil tubing jet pumps and similar hydraulic jet pumps is the ability to pump without moving pump components. As well, in a coil tubing jet pump installation, the numerous problems associated with a long reciprocating pump sucker rod string within the borehole running all the way from the surface to the pump are eliminated. The present invention may be used with coil tubing jet pumps or other types of hydraulic artificial lift pumps that may or may not be replacing existing sucker-rod-type reciprocating pumps. Thus, the present invention may be used with standard downhole seating nipples from preexisting pump assemblies that normally are associated with sucker-rod-type reciprocating pumps. The present invention may also be used with newly manufactured pumps and bottomhole assemblies.

For purposes of a concise explanation, only the coil-tubing-type hydraulic jet pumps are discussed herein, and it will be understood that application of the present invention is to hydraulic artificial lift techniques generally. With operation of coil tubing jet pumps, an injection fluid such as oil or water is pumped down the coil tubing string into the coil tubing jet pump at a high pressure to thereby transfer energy to the production fluid via a momentum transfer process within the throat portion of the jet pump. The momentum transfer process increases the net energy of the production fluids such that production fluids have sufficient pressure energy to push the fluids to the surface. The operation of the jet pump draws the low pressure fluid from the formation. The injection fluid and production fluids are mixed in the throat of the coil tubing jet pump and discharged into an annular space between the outside wall of the coil tubing and the inside wall of the production tubing string. The mixed fluids flow through the annulus or other pipes to the surface, where the production fluids are captured. Thus, the production fluids are induced by the jet pump to mix into the circulation path of fluids within the production string/coil tubing string annulus so as to be pumped to the surface. Typical of patented jet pumps are the pumps disclosed in U.S. Pat. Nos. 1,355,606; 1,758,376; 2,287,076; 2,826,994; 3,215,087; 3,887,008; 4,183,722; 4,293,283; 4,390,061; 4,603,735; 4,658,693; 4,790,376; and 5,083,609.

The coil tubing jet pump assembly lands in a coil tubing jet pump bottomhole assembly (BHA) that is connected to a reservoir connection, typically a sucker-rod-type reciprocating pump seating nipple, that leads to the pay zone or reservoir from which wellbore fluid, flow. Thus, the seating nipple is connected for communication with the reservoir or production zone of the wellbore. Production fluids flow from the production zone of the formation, typically through the seating nipple of sucker-rod-type pump completions, through a standing valve, as may be found in a flow path in the bottomhole assembly discussed in more detail hereinafter, and into the coil tubing jet pump. The seating nipple may typically be of the type normally used for mechanically latching onto a sucker-rod-type reciprocating pump assembly. Three typical types of such seating nipples and landing devices would include those that have a top mechanical hold-down, a bottom mechanical hold-down, and a multiple-cup hold down. Reference is made to API Standard 11-AX for typical completion components and techniques. The hold-down elements of the seating nipple and of the landing/latching device secure the reciprocating sucker-rod-type pump to the seating nipple so that the reciprocating rod pump does not ride up in the wellbore on the up stroke of the reciprocating sucker rods and provides the fluid seal necessary between fluids in the production tubing at pressure and the production fluids in the reservoir at some lower pressure.

One problem that may be encountered when using coil tubing jet pumps is the problem of making a fluid-tight connection to the seating nipple with the coil tubing jet pump bottomhole assembly. In certain situations, particularly in horizontal wellbore applications and/or in deep boreholes, or highly deviated wellbores, or wellbores that otherwise have significant frictional drag on the coil tubing, such as wells with highly viscous material therein or due to frictional drag from coil tubing to production tubing contact as may occur due to sharp turns or doglegs along the borehole, it is often difficult to drive a mechanical latching device into the seating nipple using the rather flexible coiled tubing. In fact, it is submitted that the coil tubing may bend or buckle before sufficient force is produced to latch into the API-11AX seating nipple typically installed as standard equipment. As well, mechanical latch components as used in prior art devices for latching to the seating nipple typically require significant insertion force or may become sufficiently clogged or blocked so that the small pushing force available at the bottom of the well for the BHA may not be sufficient for reliable latching. Not only must the coil tubing jet assembly be securely connected to the seating nipple, but also the connection must be fluid-tight. If the connection is not fluid-tight, then the injection fluid and production fluids discharged into the annular space at high pressure between the outside of the coil tubing and the inside wall of the production tubing string will flow through the seating nipple to thereby impede or prevent operation of the coil tubing jet pump. Thus, there is a first problem of making the seating nipple connection.

A second problem encountered is that of breaking the seating nipple connection, i.e., of releasing the downhole assembly from the seating nipple. Just as the pushing power of coil tubing at the bottom end thereof is greatly diminished in deep and/or highly deviated holes as discussed above, the pulling strength of coiled tubing at the surface is also quite limited in such situations due to the yield strength of the coil tubing in tension. The weight of all the tubing in the wellbore, plus friction force acting thereon throughout the length of the wellbore, plus any unlatching mechanism force for the seating nipple connection, plus forces such as sticking due to differential force as discussed below, or other forces, are applied to the coil tubing. Such forces sometimes cause the coil tubing to part or become mechanically damaged during attempted removal of the coil tubing, thereby possibly resulting in a costly and time-consuming fishing job.

Assuming that the seating nipple connection is fluid-tight, a differential pressure will typically be formed across the standing valve in the BHA due to a relatively low formation pressure below the standing valve as compared with a relatively high hydrostatic pressure in the coil tubing/production tubing annulus. It is submitted that this pressure differential may create a large force that must also be overcome before the coil tubing jet downhole assembly can be removed from the seating nipple. It is therefore submitted herein according to the above analysis of the problem that the load required to break the fluid seal may often be a significant portion of an imposed load on the coil tubing. In summary, as discussed above, depending on the depth and deviation of the wellbore, and other forces, the coil tubing may not have enough tensile strength at the surface to unlatch the assembly and may even part due to such forces acting thereon.

Consequently, there remains a need for an installation and removal system for coiled tubing jet pumps and artificial hydraulic lift installations generally that allows for more reliable connection, sealing, and disconnection from downhole components, such as the various types of reservoir connections, that typically comprise seating nipples. Those skilled in the art will appreciate the present invention that addresses these and other problems.

SUMMARY OF THE INVENTION

The installation/removal assembly and method of the present invention may be used with hydraulic artificial lift installations such as a coil tubing jet pump BHA secured to a reservoir connection, such as a seating nipple. The present invention addresses problems including improving latching/unlatching methods and devices for a downhole assembly of the coil tubing jet pump BHA. It is submitted that the present invention may often reduce the forces involved in several ways and improve the reliability of making/breaking such connections.

An assembly is disclosed for use in a wellbore having a pump therein for pumping a well fluid out of a reservoir portion of the wellbore. An outer tubular member, such as production tubing or casing, and an inner tubular member, such as coil tubing, are mounted in the wellbore such that an annulus is formed therebetween. A standing valve, such as a one-way ball valve, is positioned in the wellbore for controlling flow of the well fluid from the reservoir portion to the pump. The valve experiences a differential pressure when in the closed position with a higher pressure on one side of the valve than on an opposite side of the valve. A longitudinal section of the annulus is positioned between the valve and the reservoir.

The assembly of the invention comprises first and second members that may be secured to the inner tubular member. The first and second members are relatively moveable, such as in a longitudinal direction, with respect to each other between a first longitudinal position and a second longitudinal position. The first and second members define therein a first flow path to permit the well fluid to flow from the reservoir portion of the wellbore to the standing valve and, when the valve is in the closed position, to direct flow to the suction ports of pump.

A seal is positioned between the first and second members to seal off communication between the flow path and the higher pressure when the first and second members are in the first longitudinal position and the valve is in the closed position. The first and second members are fashioned such that a second flow path is formed to allow communication between the first flow path and the annulus when the first and second members are in the second longitudinal position. The first and second members are relatively moveable preferably in response to longitudinal movement of the inner tubular. As well, the first and second members are each tubular and telescopingly arranged with respect to each other.

In one embodiment shown in FIGS. 5A/5B, the second flow path may further comprise first and second openings defined in the first and second members, respectively, wherein the first and second openings are aligned when in the second longitudinal position. Preferably, the first inner tubular member supports the standing valve therein, and the second member is in surrounding relationship to the first tubular member. The second flow path aperture may be a longitudinal slot or a port or other type of opening suitable for the flow of fluids and pressure relief. In this embodiment, the aperture is in communication with the longitudinal section of the coil tubing/production tubing annulus positioned between the standing valve and the reservoir when the first and second members are in the second longitudinal position.

In another embodiment, shown in FIGS. 6A/6B, the second flow path may comprise openings in the first member that are exposed directly to the longitudinal section of the coil tubing/production tubing annulus when in the second longitudinal position. Preferably, the first inner tubular member supports the standing valve therein, and the second tubular member is in surrounding relationship to the first tubular member. The flow path may be a longitudinal slot or port or other type of opening suitable for the flow of fluids and pressure relief. In this embodiment, the aperture is also in communication with the longitudinal section of the coil tubing/production tubing annulus positioned between the standing valve and the reservoir connection when the first and second members are in the second longitudinal position.

In yet another embodiment of the invention, shown in FIGS. 2A/2B/2C and 3A/3B, a second flow path is formed between the first and second members, and the second flow path extends across the valve. The second flow path is blocked from communicating across the valve and with the annulus typically formed by the first and second members when the first and second members are in the first longitudinal position and the valve is in the closed position. The second flow path is open for communication across the valve and with the annulus typically formed by the first and second members when the first and second members are in the second longitudinal position.

In a preferred embodiment, a tubular member, such as a guide connection member, is disposed at a furthermost end of the assembly such that the tubular member has an outer diameter slightly smaller than the inner diameter of the reservoir connection, i.e., the seat nipple, and extends substantially into the reservoir connection. The tubular member defines therein a flow path to permit the well fluid to flow from the reservoir portion of the wellbore to the standing valve and, when the standing valve is in the open position, to the jet pump. A tubular sealing section adjacent to the tubular member may be used for sealing with reservoir connection. The assembly has no radially extendable/retractable latches, such as prongs or other gripping elements, and is securable in position by a force arising from the differential pressure acting across the one-way valve/annular pressure/ hydrostatic pressure. In operation, the tubular member acts as a guide member secured to the coil tubing jet pump assembly and guides the assembly into connection with the reservoir connection. The guide member defines therein a reservoir fluid flow path such that the guide member aligns a sealing section with said reservoir connection for sealing between the reservoir connection and the reservoir fluid flow path. The connection uses only a hydraulic force that arises from a differential pressure between said hydrostatic/annular pressure and the reservoir pressure for securing the guide member and the coil tubing jet pump assembly within the wellbore to the reservoir connection. Any additional down force applied by slack-off of the top joint tension of the inner tubular member further assures the seal integrity at the reservoir connection.

In one possible embodiment, the tubular sealing section's seal effectiveness is augmented by an elastomeric seal, such as an O-ring seal, for sealing with the reservoir connection. In a presently preferred embodiment, the tubular sealing section comprises a malleable metal for forming a metal-to-metal seal with the reservoir connection. The malleable metal preferably is formed in a conical portion of the tubular sealing section. While a purely soft or malleable metal seal has been used in making a connection to the reservoir connection in the past, the various difficulties discussed above, in many cases, have severely limited the likelihood that the seal would be effected in the context of hydraulic artificial lift operations such as, for instance, hydraulic-artificial-lift-type cool tubing jet pumps.

A method for making a retrievable jet pump installation comprises steps such as providing a first member, such as a tubular member, with a one-way standing valve therein for controlling flow of a wellbore fluid to the coil tubing jet pump. As with the preferred embodiment of the apparatus, the first member is operable for defining therein a flow path far flow of the wellbore fluid from the reservoir through the one-way standing valve when the one-way standing valve is open, and then to the coil tubing jet. Closure of the one-way standing valve may produce a differential pressure acting on the one-way standing valve with a higher pressure on one side of the standing valve than on the other. A second member is mounted to the first member for movement in a limited range with respect to first member to fashion a respective first position and a respective second position. A seal is provided between the first and second members to seal off communication between the flow path and the higher pressure when the first and second members are in the first position and the one-way standing valve is closed. The first and second members are fashioned to open a second flow path to allow communication between the first flow path and the higher pressure on one side of the one-way standing valve, when the one-way valve is closed. At least one of the first and second members is suitable for removable fastening to the reservoir connection. In one embodiment, the first and second members may define the second flow path therebetween such that the second flow path extends across the one-way standing valve so as to equalize the differential pressure across the one-way standing valve when the one-way standing valve is closed and the first and second members are in the second position. In another embodiment, the first and second members define the second flow path such that the second flow path is in communication with the coil tubing/production tubing annulus when the one-way standing valve is closed and the first and second members are in the second position. In the latter configuration, a well treatment fluid can be introduced into the reservoir via the second flow path.

It is an object of the present invention to provide an improved hydraulic reciprocating and hydraulic jet pump installation/removal assembly and method.

It is another object of the present invention to provide an installation with at least one tubular member firmly held in position with respect to the reservoir connection by means of a hydraulic latch.

It is yet another object of the present invention to provide a bottomhole assembly with a downhole latch that operates without downhole radially moving latch components such as prongs or other latch components.

It is yet another object of the present invention to equalize and/or reduce differential pressures that resist removal of the installation from the reservoir connection, e.g., the seating nipple.

A feature of an embodiment of the present invention is relatively moveable elements responsive to longitudinal movement of the coil tubing to open/close a passageway for equalizing pressure across the one-way standing valve.

Another feature of an embodiment of the present invention is a fluid passageway formed directly across or adjacent the one-way standing valve that may be opened or closed to equalize differential pressure that builds up when the one-way standing valve is closed.

An advantage of the present invention is the elimination of the need for a downhole mechanical latch mechanism with laterally moving parts, such as prongs, which may become inoperable.

Another advantage of the present invention is the elimination of insertion or removal forces at the reservoir connection that may prevent the installation from being either installed or removed due to limitations of surface equipment.

Yet another advantage is elimination of numerous possible problems associated with any attempt to provide wireline or smaller tubing conveyed equipment to try to open a port such as by breaking off the one-way valve, to equalize the pressure across the oneway standing valve including problems such as side doors, additional surface equipment, logistical problems of placement of additional surface equipment, downhole restrictions, faulty latch components, sticking or parting assemblies that cause loss of wireline or small tubing, and other associated problems.

These and other objects, features, and advantages of the present invention will become apparent from the drawings, the descriptions given herein, and the appended claims.

While the present invention will be described in connection with presently preferred embodiments, it will be understood that it is not intended to limit the invention to those embodiments. On the contrary, it is intended to cover all alternatives, modifications, and equivalents included within the spirit of the invention and as defined in the appended claims.

DETAILED DESCRIPTION OF THE PREFERRED EMBODIMENTS

With reference now to the drawings, and more particularly to FIGS. 1A through 1F, there is shown an overview of an coil tubing jet pump installation/removal system 10 for a coil tubing jet pump 12 in accord with the present invention.

Figure 1A:
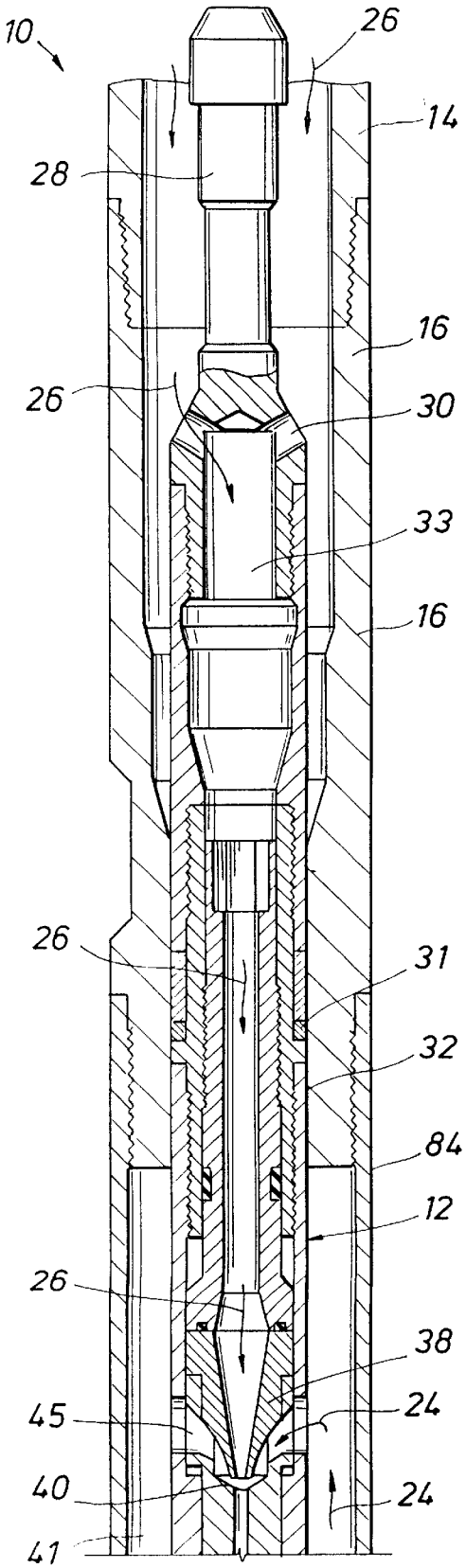
FIG. 1A is an elevational view, partially in section, of a longitudinal portion of a coil tubing jet pump assembly and bottomhole assembly in accord with the present invention.
Figure 1B:
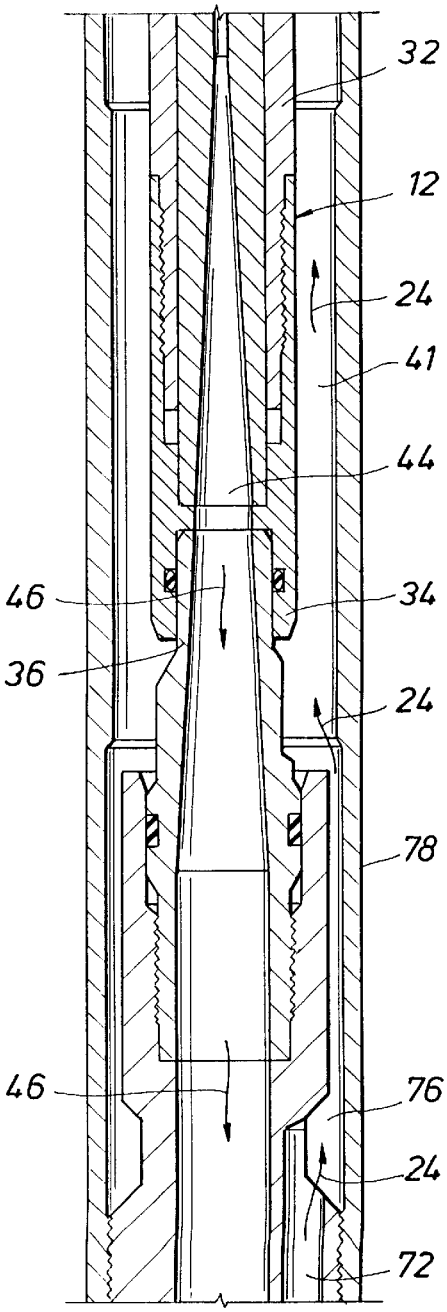
FIG. 1B is an elevational view, in section, of a second adjacent longitudinal portion of the coil tubing jet pump assembly and bottomhole assembly of FIG. 1A shown in an open position so as to equalize differential pressure across a one-way standing valve.
Figure 1C:
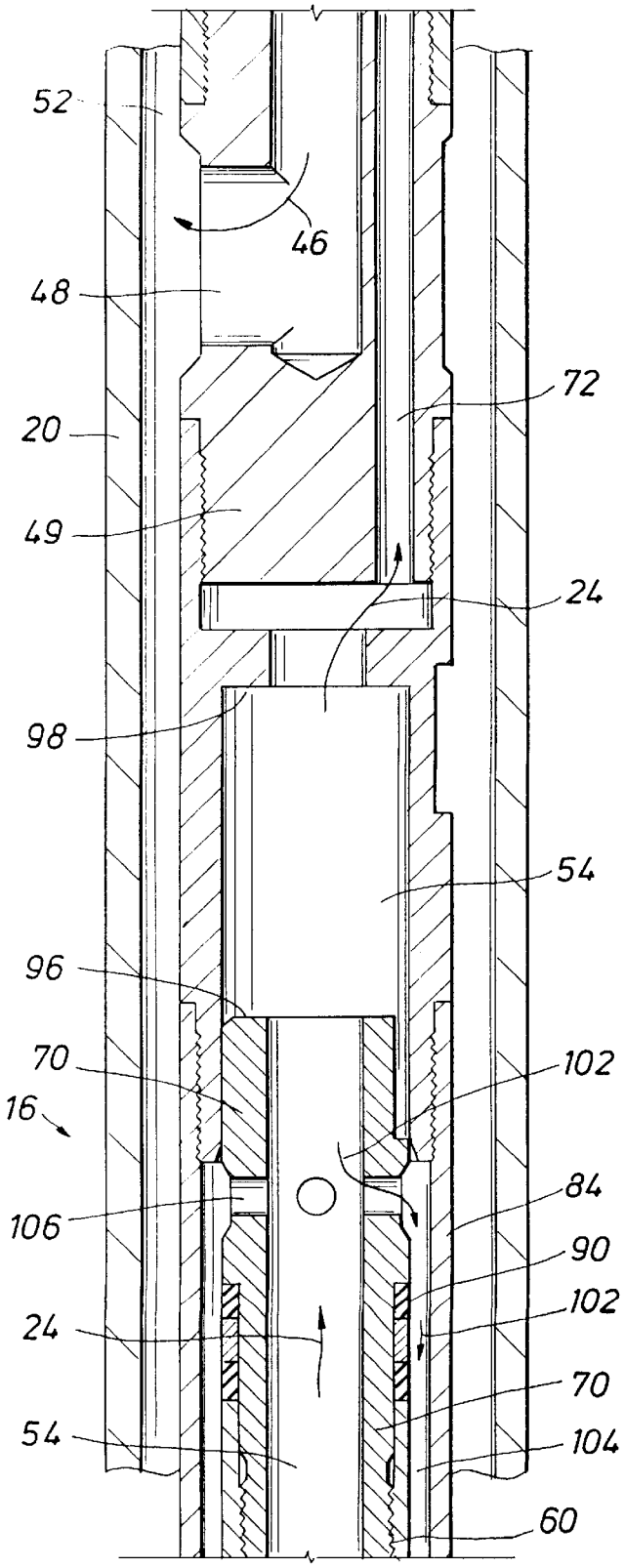
FIG. 1C is an elevational view, in section, of an adjacent longitudinal portion of the coil tubing jet pump bottomhole assembly of FIG. 1B shown in an open position so as to equalize differential pressure across the one-way standing valve.
Figure 1D:
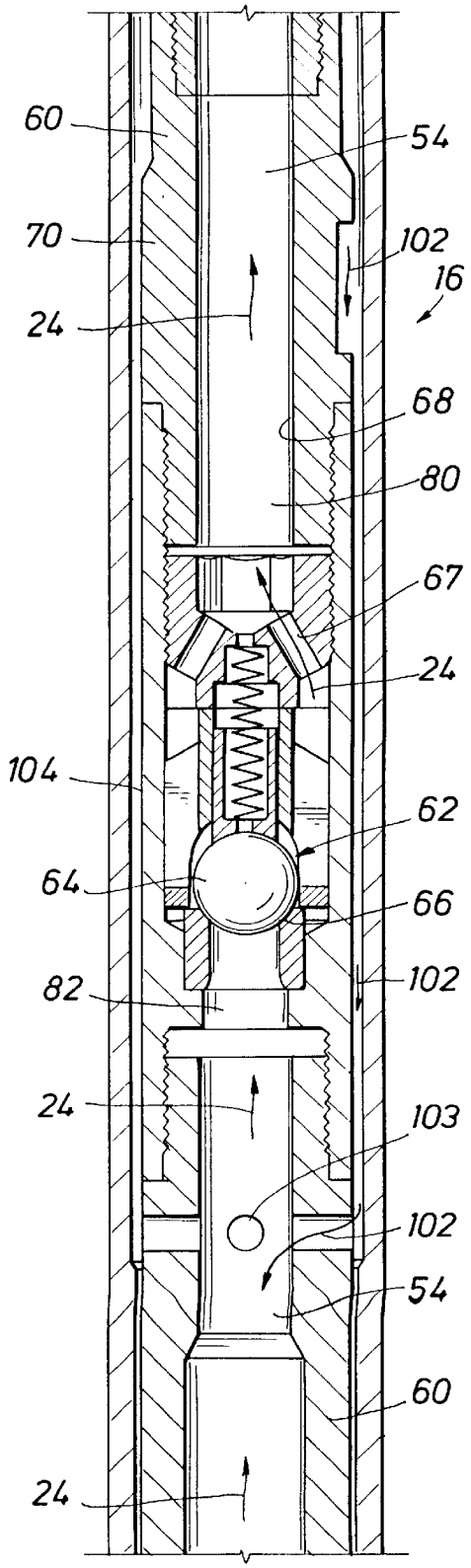
FIG. 1D is an elevational view, in section, of an adjacent longitudinal portion of the coil tubing jet pump bottomhole assembly of FIG. 1C shown in an open position so as to equalize differential pressure across the one-way standing valve.
Figure 1E:
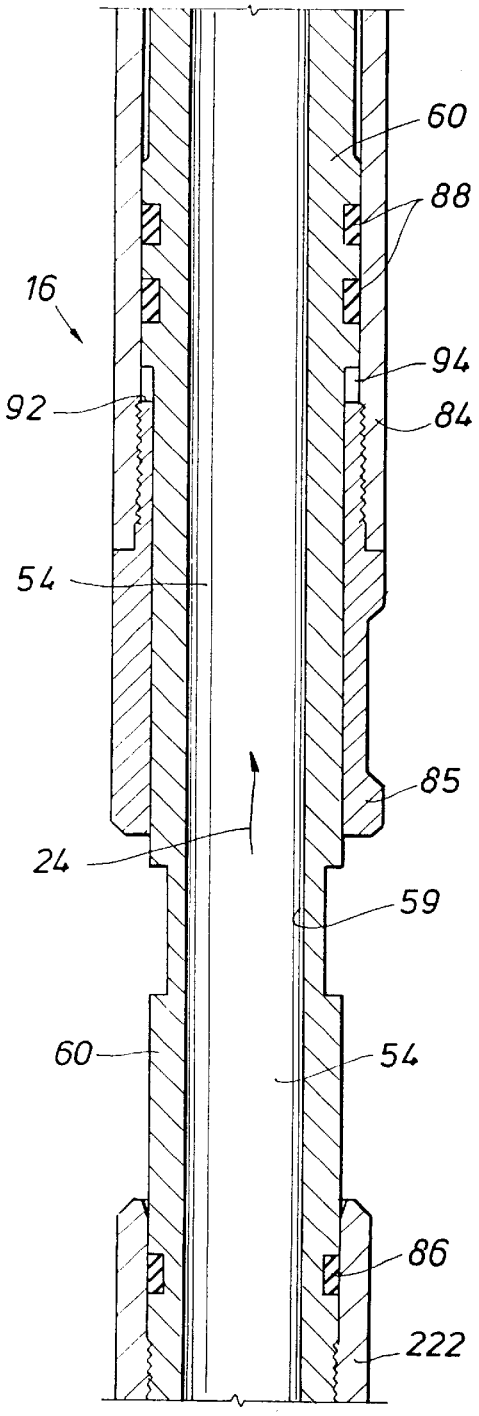
FIG. 1E is an elevational view, in section, of an adjacent longitudinal portion of the coil tubing jet pump bottomhole assembly of FIG. 1D shown in an open position so as to equalize differential pressure across the one-way standing valve.
Figure 1F:
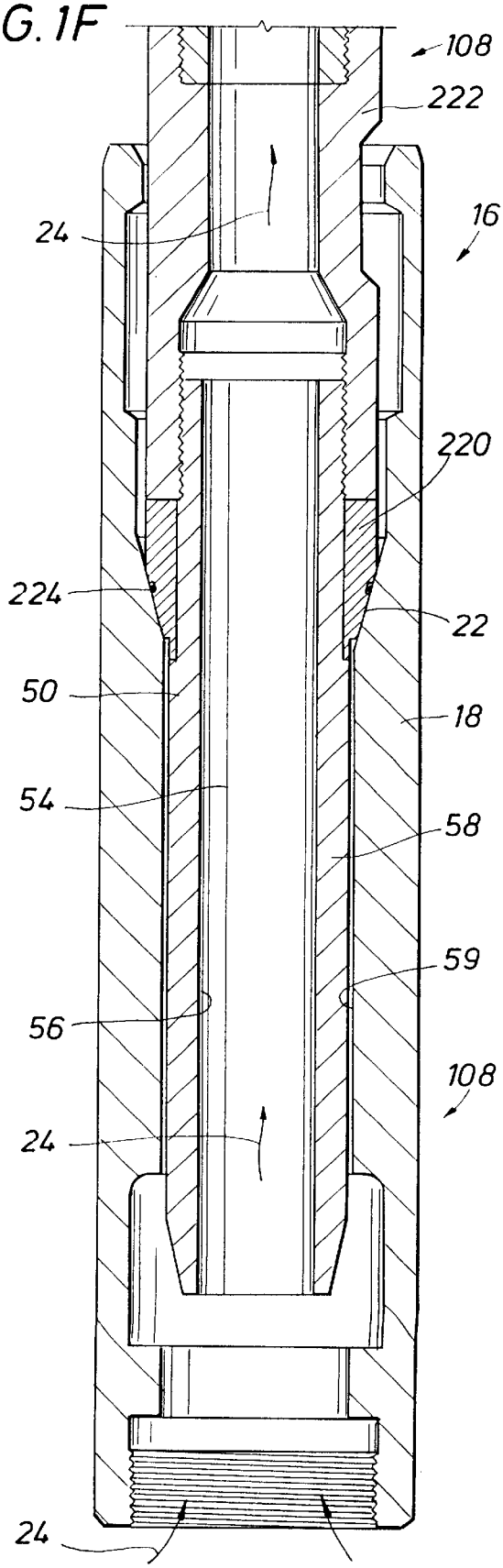
FIG. 1F is an elevational view, in section, of an adjacent longitudinal portion of the coil tubing jet pump bottomhole assembly of FIG. 1E with hydraulic connection guide member positioned in a reservoir connection such as a production seat nipple.

FIGS. 1A through FIG. 1F shows the coil tubing jet pump bottomhole assembly extension adapter 14 where connection to a coil tubing connector is made by a thread adapter secured on the end of the coil tubing string (FIG. 1A) and which is referred to subsequently more generically simply as coil tubing 14. Coil tubing 14 in turn is attached by threads to an upper part of jet pump bottomhole assembly 16. As shown in FIG. 1F, assembly 16 is secured at a lower portion within seating nipple 18. Jet pump assembly 12 is illustrated in a landed position, as will be understood by those familiar with such pumps, and therefore is now located within jet pump bottomhole assembly 16. While numerous different types of jet pumps can be used with the present invention, jet pump assembly 12 (FIG. 1A–FIG. 1C) is representative of an exemplary type thereof and is used herein for purposes of general explanation. While production tubing 20 is shown only in FIG. 1C, those skilled in the art will understand that production tubing 20 extends along all figures as well as uphole, perhaps to the surface, depending on the well completion configuration. Seating nipple 18 (FIG. 1F) forms a fluid-tight seal within production tubing 20 by seal 22, discussed hereinafter, and by the mechanical seal formed by threaded connections with tubing 20. Seal 22 prevents fluid above seating nipple from flowing into the reservoir as the reservoir will typically be at a lower pressure since it has to be pumped out. Seating nipple 18 is in communication with well fluid, indicated by arrows 24, that flows upwardly out of the oil well reservoir when jet pump assembly 12 is operating.

Jet pump assembly 12 is operated by power fluids, such as water or oil as indicated by arrows 26, that are pumped through coil tubing 14 generally at high pressures, which in some parts of the pump may be in the range of about 8000 psi in this type of jet pump. Power fluids 26 flow past fishing neck 28 and into ports 30. Seal 31 (FIG. 1A) seals around jet pump subassembly 32 to require all fluid 26 to flow within passageway 33 of jet pump sub assembly 32, as indicated by fluid flow arrow 26. While fishing neck 28 could be used to fish jet pump assembly 12 with wireline (not shown), more generally jet pump assembly 12 is removed by fluidly pumping it out using reverse circulation of the power fluids. Connection socket 34 (FIG. 1B) is not threaded and simply sits in place on diffuser portion 36 so that reverse circulation would cause jet pump assembly 12 to move upwardly in coil tubing 14, if desired.

Power fluid 26 flows into nozzle 38. Well fluids are pushed into jet pump throat entrance 40 by reservoir pressure during the momentum transfer process. Well fluid 24 from the reservoir as indicated by arrows 24, flowing in annulus 41, is pushed by the reservoir pressure into ports 45 to throat entrance 40. Well fluid 24 may include various types of reservoir fluids that are probably a mixture of fluids such as water, oil, and gas. Power fluid 26 and well fluid 24 are mixed together and diffused in jet pump throat and diffuser section 44 to form mixture fluid 46, as indicated by arrows 46. Mixture fluid 46 continues to flow through pump bottomhole assembly exhaust discharge port 48 of pump bottomhole assembly suction-discharge crossover 49 (FIG. 1C). Mixture fluid 46 flows into annulus 52 formed between jet pump BHA 16 and production tubing 20. Seal element 22 (FIG. 1F) on spear assembly 50, within seating nipple 18, prevents downward flow of mixture fluid 46 by formation of a reliable fluid-tight seal by means of the present invention. Instead, mixture fluid 46 flows upwardly through annulus 52, or other production piping, to the surface where the desired portion of well fluid 24 is captured. As stated above, it will be noted that production pipe 20 (FIG. 1C) preferably extends along the length of system 10 and may or may not extend to the surface.

To reach coil tubing jet pump assembly 12 from the oil well reservoir, well fluid 24 must flow through jet pump bottomhole assembly 16 (FIG. 1A–FIG. 1F), which it does through flow path or passageway 54 (FIG. 1F). Well fluid 24 enters flow path 54 through bore 56 of spear guide 58. Flow path 54 continues through bore 58 of inner tubular member 60 that is secured to spear 58, as discussed in more detail subsequently. In this embodiment of the invention, one-way ball-type standing valve 62 is confined in inner tubular member 60. While a ball and seat valve is shown here for illustration, other one-way valises could also be used such as, for instance, poppet-type valves. In this initial discussion of flow of well fluid 24 into the jet pump assembly, it will be assumed flow of well fluid 24 proceeds as is now be described, although as discussed in some detail hereinafter, other passageway(s) may be used in accord with the various embodiments and relative positioning of the components. This allows continual use of FIG. 1A–FIG. 1F, which includes the complete assembly 10 of the present invention so as to provide better continuity of discussion and the concept of operation of a coil tubing jet pump. Therefore, until discussed hereinafter, it is assumed that well fluid 24 flows toward one-way ball-type standing valve 62, which includes ball 64 and seat 66. The differences of fluid flow as between FIG. 1A–FIG. 1F and FIG. 2A–FIG. 2C, which are the same embodiment of the invention in different operating modes, will then become readily apparent. More specifically, views of FIGS. 1C–1E and FIGS. 2A–2C are of comparable views of the same embodiment of the invention. The extremities of system 10 are not shown in FIGS. 2A–2C as in FIGS. 1A–1F to avoid excessive drawings of similar components for the present specification.

During normal operation of coil tubing jet pump assembly 12, ball 64 is lifted oil seat 66 by well fluids 24 as they travel up through the bore seat 66 and around ball 64. This permits flow of well fluid 24 along fluid path 54 to continue upwardly past ball 64, through ports 67, and into bore 68 of upper portion 70, wherein upper portion 70 of spool 60 is that portion of spool 60 above standing valve 62. Upper portion 70 is not present in all embodiments of the present invention, as seen subsequently, such as when the standing valve is secured to an outer moveable member of the bottomhole assembly, discussed subsequently. Flow path 54 continues upwardly to enter longitudinal holes 72 in suction-discharge crossover 49 that isolate well fluid 24 at reservoir pressure from mixture fluid 46, which discharges through exhaust discharge port 48 at high pressure of suction-discharge crossover 49. Once well fluid 24 exits the longitudinal holes 72 in crossover 49, then well fluid 24 flows into annulus 76, through annulus 78, and into annulus 41, as indicated by well fluid flow arrow 24. As discussed above, well fluid 24 is then drawn into ports 45 of jet pump assembly 12 so as to be pumped uphole in coil tubing/production tubing annulus 52 as a mixture of power fluid and well fluid indicated by arrow 46 exiting from pump discharge port 48.

Figure 2A:
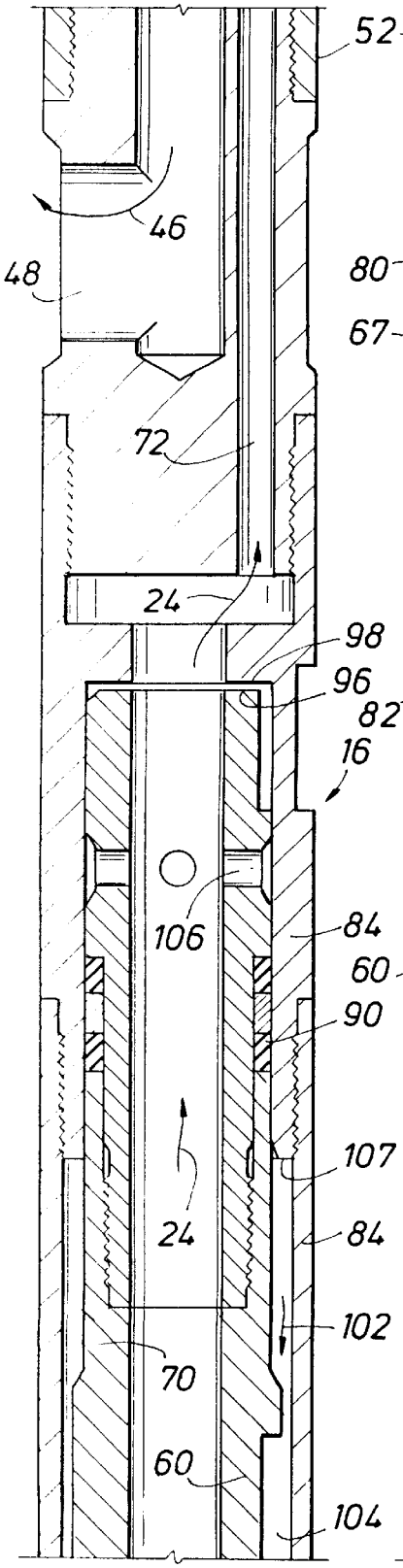
FIG. 2A is an elevational view, in section, of a longitudinal portion of the coil tubing jet pump bottomhole assembly of FIG. 1A shown in a closed position.
Figure 2B:
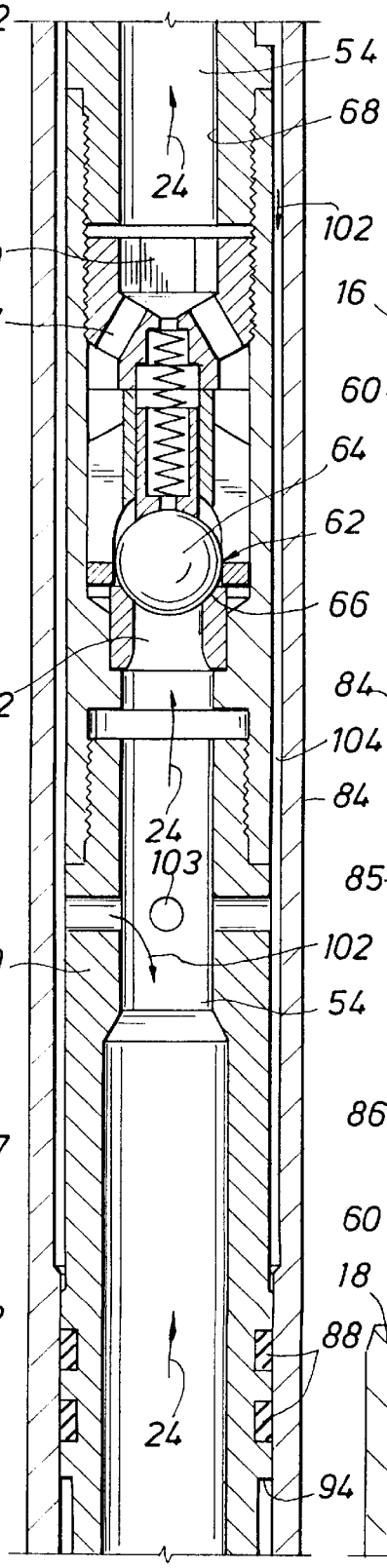
FIG. 2B is an elevational view, in section, of an adjacent longitudinal portion of the coil tubing jet pump bottomhole assembly of FIG. 2A shown in a closed position.

One of the problems/advantages considered significant as taught herein is that of a force that typically arises due to formation of a differential pressure that acts on high pressure side 80 of standing valve section 62 of FIG. 2B with respect to low pressure side 82 when the jet pump is turned off so that ball 64 is seated on seat 66, thereby creating a force that holds jet pump bottomhole assembly 16 within seating nipple 18. The present invention utilizes this same force to a unique advantage over other systems for highly effective hydraulic sealing of assembly 16 within seating nipple 18, as discussed below, when attempting to remove jet pump bottomhole assembly 16 from seating nipple 18. However, this force is also believed to be a significant factor that may prevent successful extrication of system 10. The magnitude of this force will vary due to hole conditions, including factors such as fluid densities and pump installation depth. Therefore, the present invention is provided, with reference to several configurations, to reduce or eliminate this force by equalizing the high and low pressure sides 80 and 82 of standing valve section 62.

While various embodiments are shown that have advantages/disadvantages depending on the particular hole conditions, one presently preferred embodiment for equalizing pressures is shown in FIG. 1A–FIG. 1F and FIG. 2A–FIG. 2C. It will be observed that two different relative longitudinal positions are shown for outer tubular member, jacket, or sleeve 84 with respect to inner tubular member or spool 60. This can be readily observed in FIG. 2C, where end 85 is much closer to seating nipple 18 than in FIG. 1E, where end 85 is longitudinally moved uphole further away from seating nipple 18. For reasons discussed subsequently, it will become apparent that system 10 is in a "closed" position in FIGS. 2A–2C and is in an open position in FIGS. 1A–1F.

Figure 2C:
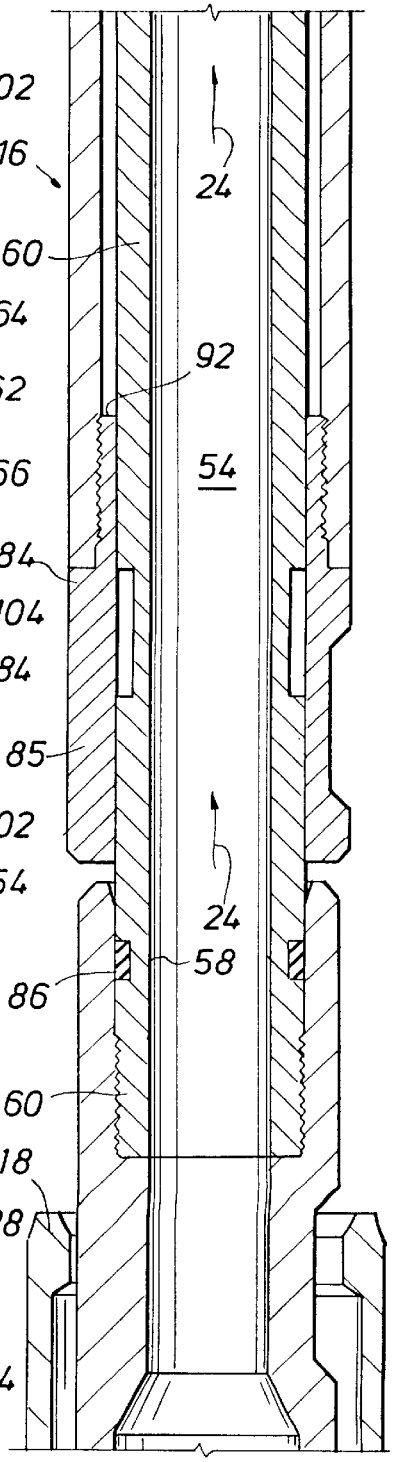
FIG. 2C is an elevational view, in section, of an adjacent longitudinal portion of the coil tubing jet pump bottomhole assembly of FIG. 2B shown in a closed position.

Prior to removal of coil tubing system 10, inner tubular member 60 is effectively fixed in position with respect to seating nipple 18 by the force caused by the differential pressure. With one-way-ball-type standing valve 62 closed, as normally occurs once pumping ceases and the well fluids at reservoir pressure are no longer able to lift ball 64 off seat 66, flow path 54 is closed off with respect to coil tubing/production tubing annulus 52, high pressure side 80, and pump output port 48, when outer tubular member 84 is in the closed position with respect to inner member 60 as shown in FIG. 2A–FIG. 2C. With one-way-ball-type standing valve 62 closed, and with inner and outer members 60 and 84 in the closed position, flow path 54 through inner tubular member 60 is scaled off from the jet pump and is open only to the well reservoir. Seals 86, 88, and 90 between inner and outer members 60 and 84 effect this sealing oft of flow path 54 in the closed position of FIGS. 2A–2C. As discussed hereinafter in more detail, different types of seals may be used in the present invention. Relative longitudinal movement between members 60 and 84 alters the sealing arrangement of seals between the respective inner and outer members, specifically that of seal 90, as discussed below.

It will also be noted that coil tubing/production tubing annulus 52 and high pressure side 80 are normally in communication with each other through pump output port 48 so that connection to one effectively connects both. However, there may be some well configurations where this may not always be the case depending on construction or hole conditions such as, for instance, debris in the annulus such as very heavy oil or sludge, and the like. The present invention has embodiments that perform the task of substantially eliminating or reducing the differential pressures created, regardless of hole conditions, that produces a force that holds system 10 in position.

It will also be noted that longitudinal movement was selected for operation of the preferred embodiment of the invention because coil tubing can reciprocate, or move longitudinally, within the wellbore but cannot rotate due to limitations of the equipment used to install the coil tubing. Therefore, the system control is made to conform to this limitation of coil tubing. However, this type of control using longitudinal movement would also work for threaded tubulars.

Outer member 84 is rigidly attached for movement with coil tubing 14, as suggested in FIG. 1A, which, as discussed above, does not include all cross-over connections for simplicity of explanation. Inner and outer members 60 and 84 are, in this embodiment of the invention, in a sliding, telescoping configuration with respect to each that allows for a limited range longitudinal movement controlled by upper and lower shoulders. Shoulder 92 on outer member 84 is an internal shoulder configured to engage radially outwardly protruding shoulder 94 formed by a diameter increase of inner member 60 to provide a stop to limit relative longitudinal movement uphole of outer member 84 with respect to inner member 60 as suggested in FIG. 1E. Shoulder 96 is an end or edge shoulder that engages the end face of socket 98 to limit longitudinal relative movement in the downhole direction of outer member 84 with respect to inner member 60. It will be noted that this arrangement comprises a jarring assembly that may also work, at least to some extent depending on hole conditions, to help effect release of assembly 10 from seating nipple 18 and entry therein so long as used cautiously. In summary, inner and outer members 60 and 84 are moveable with respect to each in a limited range between upper and lower positions, or open and closed positions wherein FIGS. 1A–1F represent the open position and FIGS. 2A–2C represent the closed position.

While path 54 is blocked by ball-type standing valve 62 as discussed above, a second flow path 102 is formed as indicated by arrow 102 through ports 103 and 106 as shown in FIGS. 1C/1D and FIGS. 2A/2B, although second flow path 102 will be seen to be blocked when system 10 is in the closed position illustrated in FIGS. 2A–2C. Arrow 102 is drawn to indicate that flow direction, when it occurs with assembly 10 in the open position, is from high pressure to low pressure. However, when assembly 10 is in a closed position, flow does not occur at all, although arrows 102 are still used to clearly point out the flow paths, though sealed off to prevent fluid flow. Port 103 leads to an inner/outer member annulus 104 between inner member 60 and outer member 84. Inner/outer member annulus 104, or second flow path 102, extends past ball valve 62, and continues outside upper portion 70 of inner member 60. In the closed position, shown in FIG. 2A, wherein shoulders 96 and 98 are abutted or adjacent, so that outer member 84 is positioned to be at or near the downhole limit of longitudinal movement with respect to inner member 60, seal 90 seals off or blocks flow path 102. In FIG. 2A, annulus 104 effectively stops below seal 90 at inner shoulder 107, where the inner diameter of outer member 84 is decreased and sealed by seal 90 when in the closed position.

Once outer member 84 is moved longitudinally uphole with respect to inner member 60, as shown in FIG. 1C, second flow path 102 through annulus 104 is no longer sealed by seal 90. As outer member 84 moves uphole relative to inner member 60, seal 90 on upper portion 70 moves into and becomes part of annulus 104 so that it no longer effective for sealing. As shown in FIG. 1C, ports 106 move into annulus 104 as outer member 84 moves uphole relative to inner member 60. Ports 106 provide a substantial flow space for equalizing pressure longitudinally across ball-type standing valve 62 between high pressure region 80 and low pressure region 82. As discussed previously, this region also connects through the coil tubing jet pump bottomhole assembly exhaust or discharge port 48 to wellbore annulus 52.

In fact, quite often prior to removal of system 10, jet assembly 12 has already been removed, as discussed previously, thereby leaving a large flow path to pump or drain fluids through discharge port 48 through diffuser 36 in a flow direction that is in reverse to that of normal pump operation. An advantage of the configuration of the invention of FIGS. 1A–1F and FIGS. 2A–2C is that, due to well circulation during operation of the pump, the coil tubing/production tubing annulus 52 at and uphole from discharge port 48 is likely to be reasonably free of debris or materials that might interfere with equalization of pressure. From discharge port 48 downhole to nipple seal 22, designated as well annulus portion 108 in FIG. 1F, circulation does not occur during pump operation so it is possible that debris of various types may have accumulated therein. Thus, the present invention provides that second flow path 102 extend through inner/outer mandrel annulus 104 longitudinally past annulus portion 108 to have an increased chance of effective equalization of pressure across ball-type standing valve 62 and wellbore annulus 52 since less debris may accumulate in second flow path 102. Once equalized, the force required for removal of system 10 may be significantly reduced, depending on hole conditions, thereby improving the likelihood that removal will be successful. Other features of the system of the present invention, such as elimination of forces required to release mechanical latches, as discussed subsequently, also improve the likelihood of successful removal of the system.

Figure 3A:
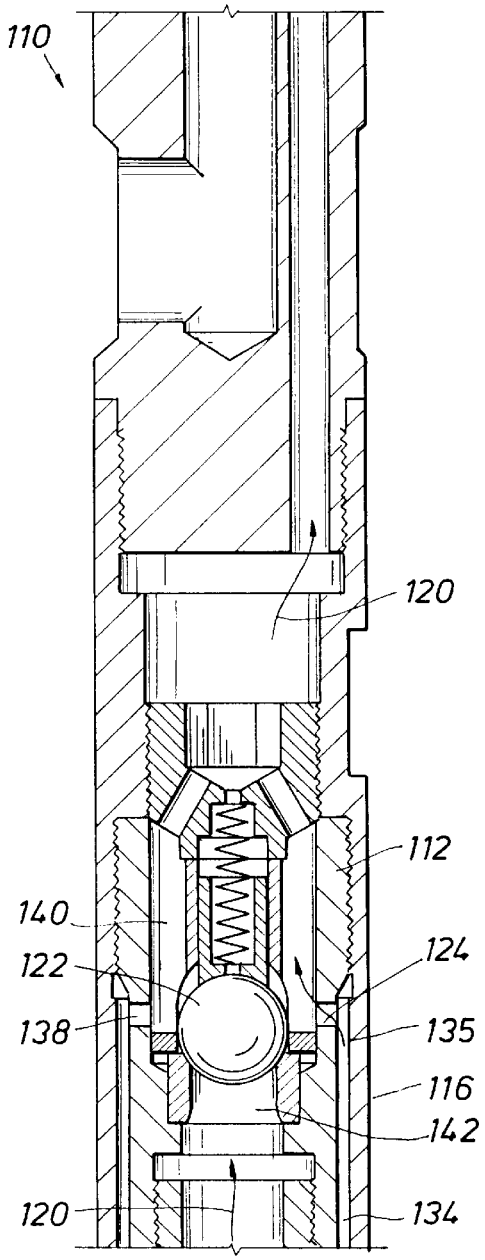
FIG. 3A is an elevational view, partially in section, is a longitudinal portion of another embodiment of the coil tubing jet pump bottomhole assembly in accord with the present invention shown in an open position to equalize differential pressure across a one-way standing valve.
Figure 3B:
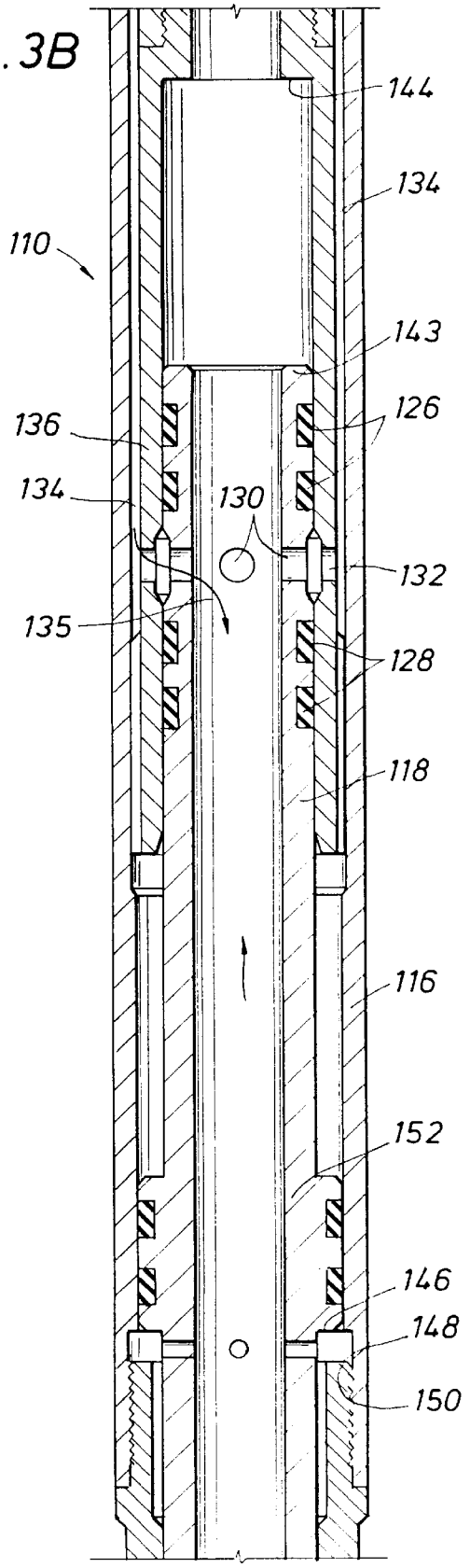
FIG. 3B is an elevational view, partially in section, of an adjacent longitudinal portion of the coil tubing jet pump bottomhole assembly of FIG. 3A.
Figure 3C:
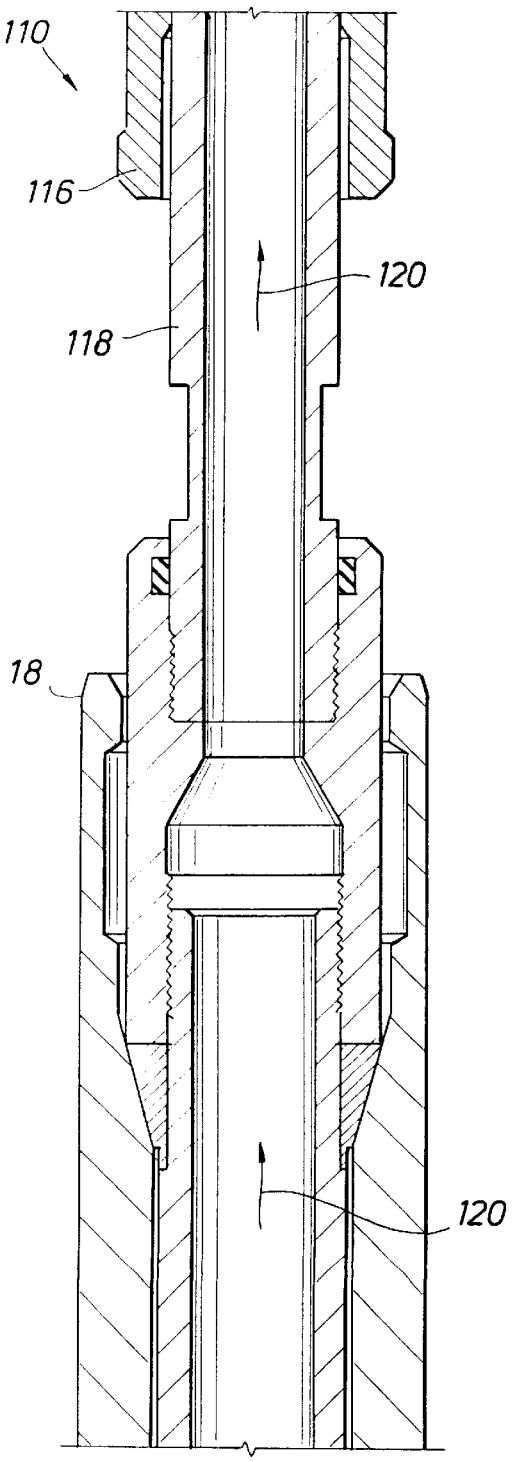
FIG. 3C is an elevational view, partially in section, of an adjacent longitudinal portion of the coil tubing jet pump bottomhole assembly of FIG. 3B.
Figure 4:
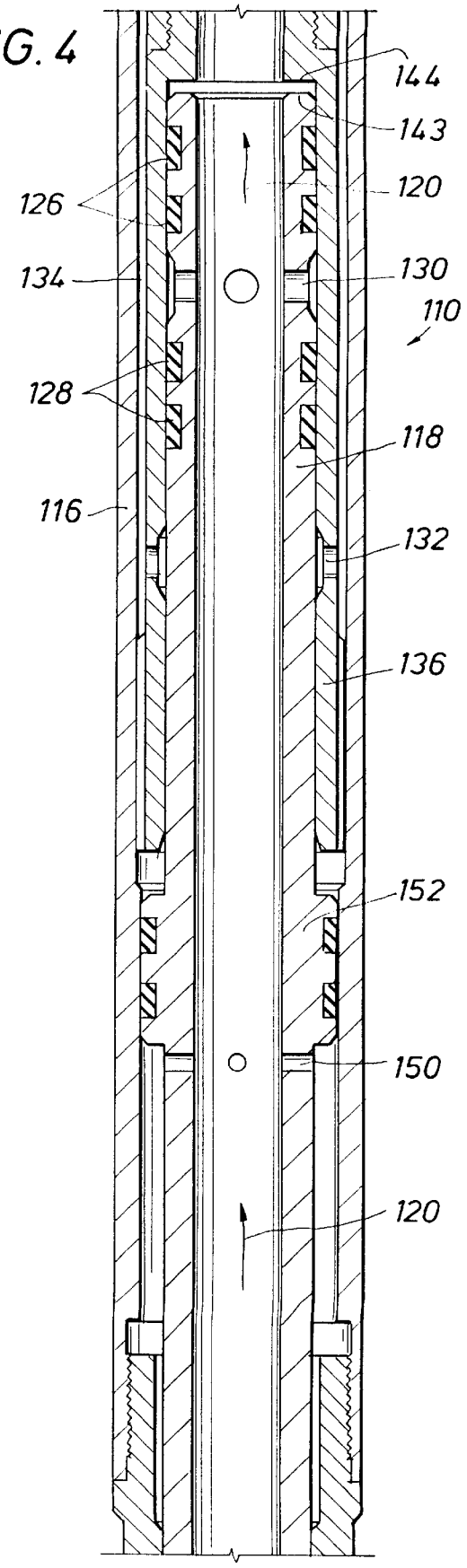
FIG. 4 is an elevational view, partially in section, of the longitudinal portion of a coil tubing jet pump bottomhole assembly of FIG. 3B in the closed position.

Another configuration of the present invention shown in FIGS. 3A–3C and FIG. 4 is system 110 for which the coil tubing pump section and seating nipple 18 are provided with limited detail to avoid unnecessary duplication in the drawings. FIG. 3A is common as the upper section for both FIG. 3B and FIG. 4. In this embodiment, one-way-ball-type standing valve section 112 is secured to outer member or jacket 116 rather than inner member 118. As previously, outer member 116 is longitudinally moveable with respect to inner member or spool 118. Inner member 118 is secured to seating nipple 18 as discussed previously and is fixed with respect to the borehole. In the same manner as discussed previously, while pumping, well fluid flows through flow path 120, as indicated by arrows and through seat 124, past ball 122 and to the coil tubing jet pump, as discussed previously. Once pumping stops, ball 122 seals off flow path 120 at seat 124, as previously discussed. As shown in FIG. 4, relatively moveable upper seals 126 and lower seal, 128 seal off spool ports 130 so that no communication occurs when inner and outer members are in the closed position as shown in FIG. 4. When jacket 116 is moved longitudinally upwardly, spool port 130 lines up with jacket ports 132 of inner jacket 136 as shown in FIG. 3B to allow flow through annulus 134 between inner jacket portion 136 and jacket 116, as indicated by flow arrow 135. Inner jacket portion 136 and jacket 116 move together. Annulus 134 leads to ports 138 just past ball seat 124 to allow equalization flow past between region 140 above ball 122 and region 142 below ball 122. Longitudinal shoulder-type stops are provided so that relative longitudinal movement is limited. Stop elements 143 and 144 prevent further relative movement of jacket 116 in a downhole direction toward the seating nipple. The bottom end of piston 146 and shoulder on jacket stop 148 prevent further relative movement of outer member 116 with respect to inner member 118 in the uphole direction. Ports 150 allow bleed off of pressure between inner member 118 and outer member 116 as jacket 118 moves upwardly in response to longitudinal upward movement of the coil tubing. Ports 150 also provide a means to supply high pressure below piston 152 that in effect will maintain inner member 118 in the closed position whenever system 110 is in the normal operating mode. In this configuration, differential forces are greatly reduced, but a small portion, about 15%, still remain due in large part to differential areas that exist with this configuration.

Figure 5A:
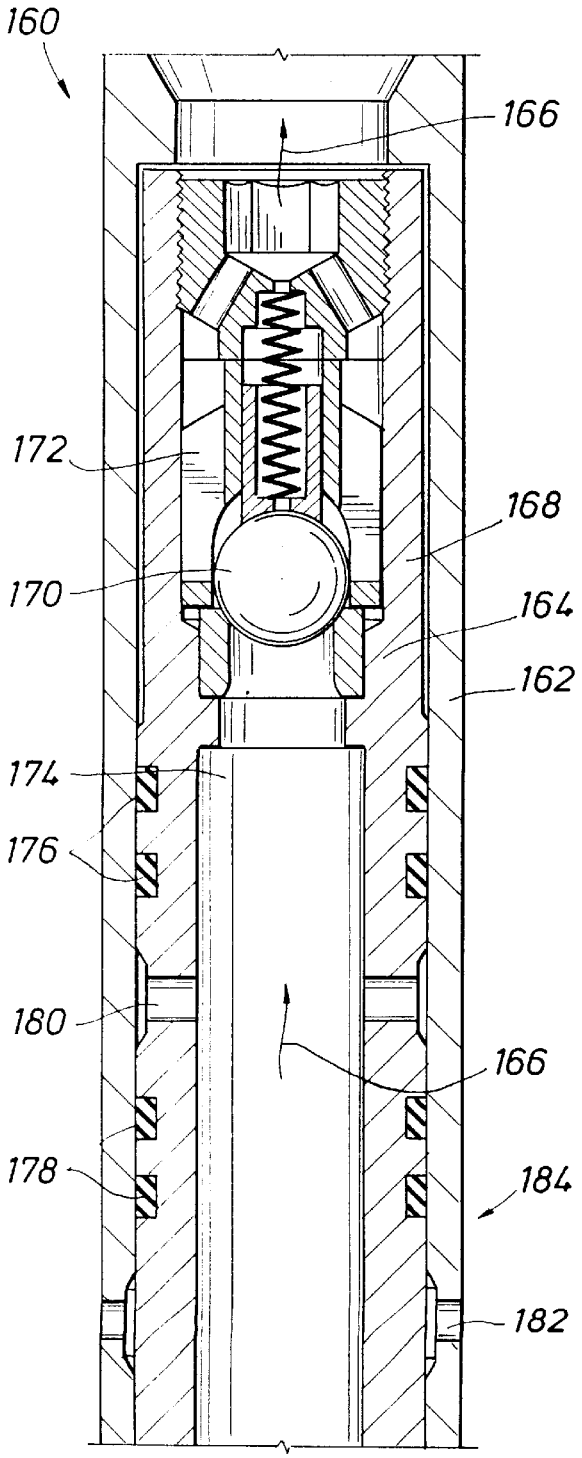
FIG. 5A is an elevational view, partially in section, of a longitudinal portion of another embodiment of a coil tubing jet pump bottomhole assembly in accord with the present invention.
Figure 5B:
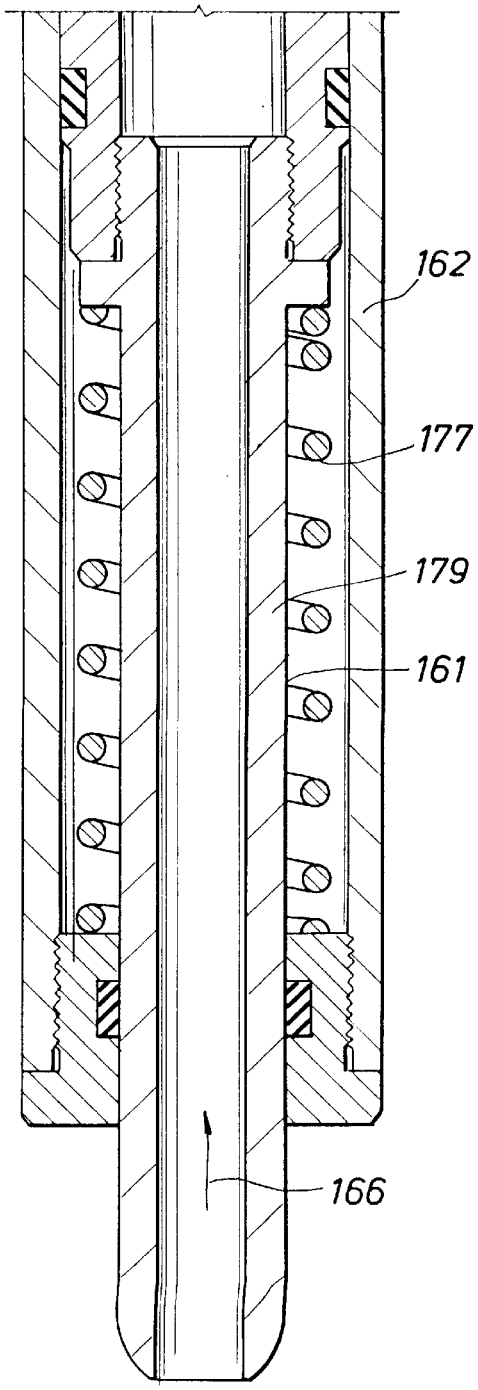
FIG. 5B is an elevational view, partially in section, of an adjacent longitudinal portion of the coil tubing jet pump bottomhole assembly of FIG. 5A.

In FIGS. 5A and 5B, another configuration of the present invention, system 160 is shown. While system 160 shows a spring-loaded spear assembly 161, a spear assembly such as spear assembly 50 is the presently preferred embodiment. In system 160, outer member or jacket 162 is moveable with respect to inner member 164. In FIGS. 5A and 5B, system 160 is shown in the closed position. During pumping operation flow path 166 as designated by the arrows corresponds to the flow of well fluid from the reservoir that leads through ball-type standing valve 168 in the same manner as discussed previously. When one-way ball valve 168 is closed, flow path 166 is closed off, and pressure builds up above ball 170 in above valve region 172 as compared to below valve region 174. Relatively moveable upper seals 176 and lower seals 178 surround ports 180 to prevent flow of well fluid through ports 180. As seals are discussed subsequently in more detail, single seal configurations are acceptable. However, when the coil tubing is moved longitudinally upwardly by the selected amount so that outer member 162 and inner member 164 have jacket ports 182 and spool ports 180 lined up at the open position, then a second flow path is opened that leads directly to coil tubing/production tubing annulus 184, so that equalization occurs. Upper region 172 will be in communication with coil tubing/production tubing annulus 184 pressure through pump discharge port 48 (FIG. 1C) to thereby equalize the pressure. This configuration may be referred to as an external communication type because communication is directly to the outside of the jacket or outer member. On the other hand, the system 10 and 110 configurations previously discussed may be referred to as internal communication because communication is inside the jacket or outer member with no ports directly exposed to wellbore annuls 184. Spring 177 and guide 179 in this embodiment operate to maintain inner member 164 against stop shoulders. The spring is preferably not used in the presently preferred embodiment. Guide assemblies are discussed hereinafter.

Figure 6A:
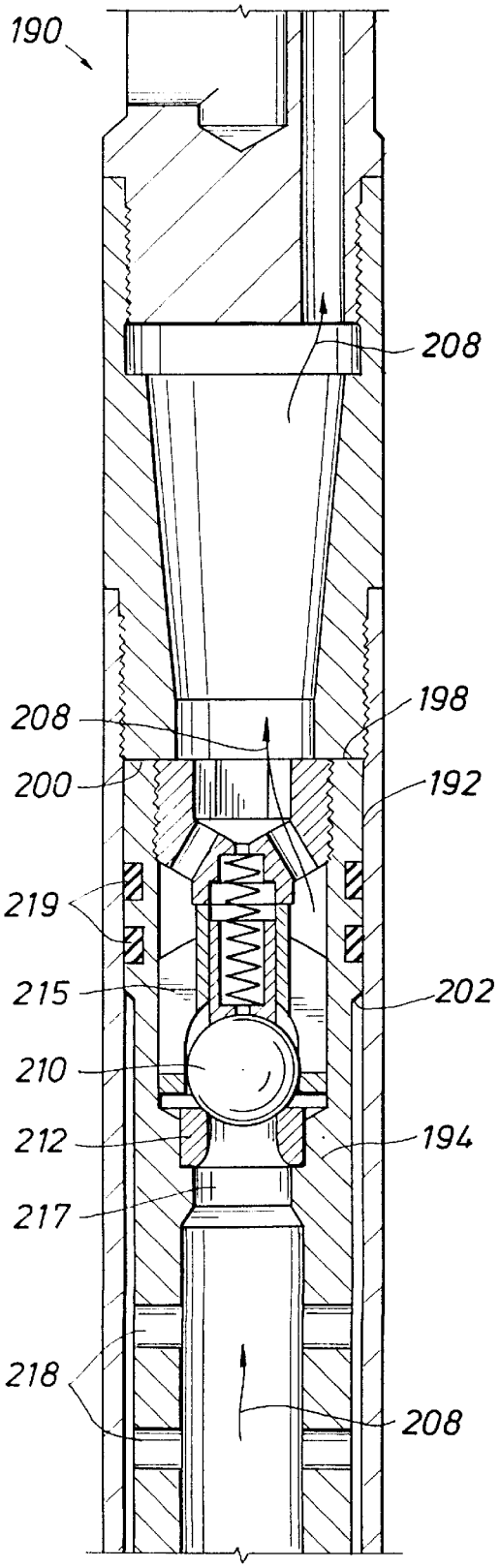
FIG. 6A is an elevational view, partially in section, of a longitudinal portion of yet another embodiment of a coil tubing jet pump bottomhole assembly in accord with the present invention shown in the closed position.
Figure 6B:
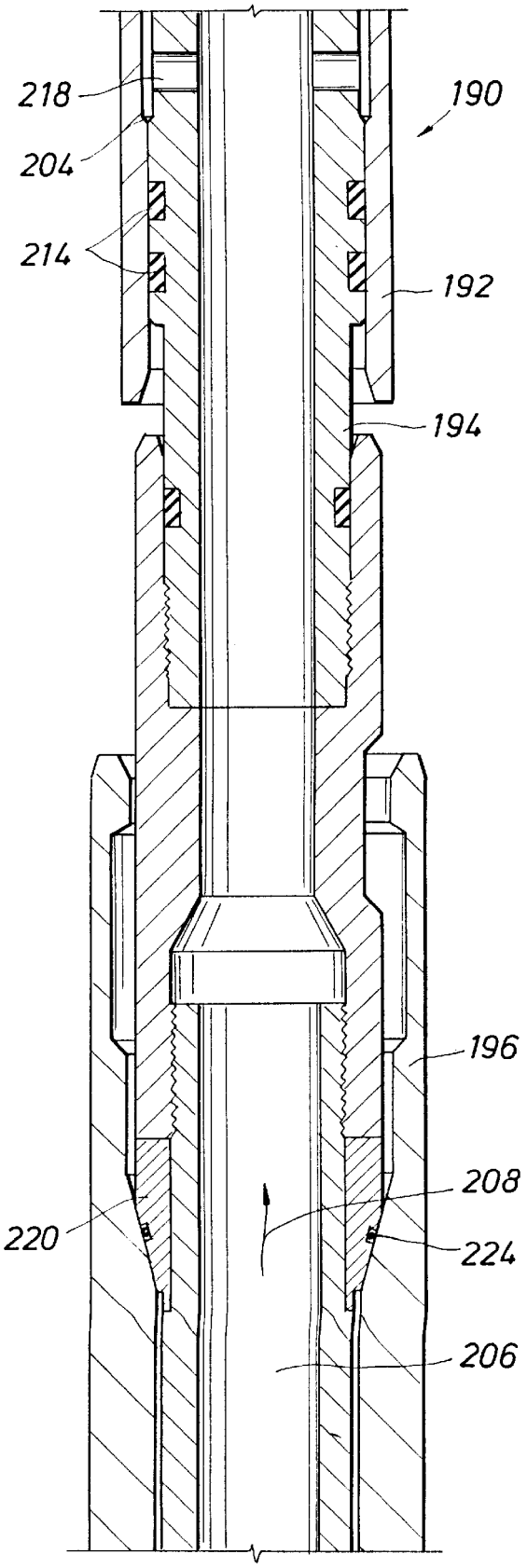
FIG. 6B is an elevational view, partially in section, of an adjacent longitudinal portion of the coil tubing jet pump bottomhole assembly of FIG. 6A.

FIGS. 5A and 6B disclose another embodiment of the present invention, system 190. Outer member or jacket 192 is moveable in response to longitudinal movement of the coiled tubing with respect to inner member or spool 194 that is affixed to seating nipple 196. The span of longitudinal movement permitted is controlled by stops such as nose stop 198 and shoulder 200 that control the closed position or movement downhole of outer member 192 with respect to inner member 194. Uphole movement of outer member 192 to the open position with respect to inner member 194 is limited by stop shoulders 202 and 204. When in the closed position, fluid flow through bore 206 as indicated by fluid path 208 arrow and during pump operation is the substantially the same as discussed previously. When pump operation ceases, and ball 210 moves to seat 212, then fluid flow path 208 to the annulus is sealed off by seals 214 when outer member 192 is in the close position as illustrated in FIGS. 6A–6B. Pressure communication between above valve region 215 and below valve region 217 is eliminated by seals at location 219. System 190 is of the external communication variation of embodiments, as discussed above. When outer member 192 moves to the open position due to longitudinally upward movement of the coiled tubing, then various types of communication ports can be used to equalize pressure directly to the annulus including holes 218, which could also be slots or other types of apertures, as desired.

While the equalizing configurations reduce the force required for removal by equalizing pressure, a spear section of the present invention is used to further reduce removal force. With reference to FIG. 1F, spear assembly 50 is used to replace what were previously required latches used for mechanical latching of reciprocating sucker rod type pumps. Spear assembly 50 of the present invention in the preferred form has no moving latch parts, such as radially extending/retracting prongs, that may increase the insertion force and increase the removal force. Thus, spear assembly 50 reduces both of those forces to significant advantage for use with coil tubing jet pumps or other completion equipment requiring a minimum insertion and removal force. While soft or malleable metals, such as brass, are typically used to provide spear seal 22 by means of malleable material ring 220, the lack of force to press onto the seal that may occur with coil tubing as discussed previously increases the possibility of poor sealing. Using straight spear guide 58 eliminates the latch forces, thereby improving the likelihood of good sealing by compressing the metal-to-metal seal. Spear guide 58 extends through seating nipple 18 as illustrated having an outer diameter sized to slidingly fit into the inner diameter of bore 59 of seating nipple 18. As discussed above, the effective creation of a jar in bottomhole assembly 16 may also be of some use compressing the metal-to-metal seal rind 220, but care must be taken to avoid buckling damage to the coil tubing or bottomhole assembly. Spear assembly 50 includes spear crossover element 222 that connects to the removal configuration inner member. Crossover element 222 also includes cone-shaped spear seal ring 220. In another embodiment of the present invention, an O-ring 224 or other type elastomeric seal element may be used, such as within or instead of the malleable metal of seal portion 220, to further improve the likelihood of good sealing as indicated in FIGS. 1F/6B. O-ring 224 or another seal element could also be located along spear assembly 50 for sealing with seating nipple 18. Once spear assembly 50 is landed and sealed, the differential force arising between the annular/hydrostatic pressure and the typically lower reservoir pressure is used to provide the beneficial purpose of anchoring the inner member of the bottomhole assembly as discussed above while eliminating the latch mechanism insertion and removal forces.

Where the shown embodiments of the invention are often pictured with two seals such as O-ring type seals and/or glands at the seal locations, redundant seals are not absolutely necessary. Redundant seals are shown for seal integrity in the normally hostile well environment, but single seals at each location will suffice for proper operation. In addition, seals of differing configuration or profile in place of the standard O-ring-type seals or other seals are also acceptable. The illustrated seals are shown mainly for purposes of easy understanding of operation of the invention.

It will be understood from the numerous different embodiments of the present invention that changes in configurations to perform the basic concepts of the present invention of reducing installation/removal forces are possible. For example, the outer and inner mandrel may take numerous forms so that they may be configured in different ways with different types of equalization valve components. As well, various well treatment operations can be effected by use of the present invention. When the system is in the open position, it is possible to introduce well treatment fluids such as, for instance, acid, scale inhibitors, etc., through the second flow path and then into the reservoir, as will be understood in review of the above discussion. Furthermore, the system is capable of repeated opening and closing cycles between the first and second positions. Well control operations would allow introduction of kill fluids into the reservoir through the second flow path when the system is in the open position. When the system is closed but is not connected at the reservoir connection, as in the process of inserting/removing coil tubing string, it is possible to introduce kill fluids by using fluid displacement to open the system to the second position. Well pressure control is also possible by circulation of kill fluids in either direction down the coil tubing or coil tubing/production tubing annulus when the system is closed and the standing valve is in the closed position. If the system is in the open position, the coil tubing jet pump bottomhole assembly discharge port is temporarily blocked, and the reservoir connection has not been made, then it is possible to circulate fluids down the coil tubing and return up the coil tubing/production tubing annulus to clean up the well from the reservoir connection to the surface.

Therefore, the foregoing disclosure and description of the invention are illustrative and explanatory thereof, and it will appreciated by those skilled in the art that various changes in the size, shape, and materials, as well as in the details of the illustrated construction or combinations of features of the installation/removal system, may be made without departing from the spirit of the invention. As well, the installation/removal system may be used to effect purposes such as well stimulation, treatment, clean-out, and the like.

What is claimed is:

1. An assembly for use in a wellbore having an outer tubular and an inner tubular therein such that an annulus is formed therebetween, said wellbore having a pump therein for pumping a well fluid out of a reservoir portion of said wellbore, said assembly comprising:

first and second members being securable to said inner tubular member and being mountable within said outer tubular member, said first and second members being relatively moveable with respect to each other between a first position and a second position, said first and second members defining therein a first flow path to permit said well fluid to flow from said reservoir portion of said wellbore;

a valve being secured to at least one of said first and second members, said valve having an open and a closed position, said valve controlling flow of said well fluid through said first flow path from said reservoir portion and, when said valve is in said open position, to said pump, said valve experiencing a differential pressure when in said closed position with a higher pressure on one side of said valve than on an opposite side of said valve, and a seal being positioned between said first and second members to seal off communication between said first flow path and said higher pressure when said first and second members are in said first position and when said valve is in said closed position, said first and second members being fashioned such that a second flow path is formed to allow communication between said first flow path and said higher pressure when said first and second members are in said second position.

2. The assembly of claim 1, wherein:

said second flow path extends across said valve from said one side to said opposite side.

3. The assembly of claim 1, wherein:

said seal is relatively moveable with respect to at least one of said first or second members.

4. The assembly of claim 1, wherein:

said first flow path is in communication with a longitudinal section of said annulus positioned between said valve and said reservoir when said first and second members are in said second position.

5. The assembly of claim 1, wherein said second flow path further comprises:

first and second openings defined in said first and second members, respectively, such that said first and second openings are aligned when said first and second members are in said second position.

6. The assembly of claim 1, wherein:

said first and second members are relatively longitudinally moveable with respect to each other.

7. The assembly of claim 1, wherein:

at least one of said first and second members are moveable responsively to a longitudinal movement of said inner tubular.

8. The assembly of claim 1, further comprising:

ports in one of said first or second members, said ports being exposed to said annulus in said second position.

9. The assembly of claim 1, wherein:

said second flow path is open for communication with said higher pressure on one side of said valve when said first and second members are in said second position.

10. The assembly of claim 1, further comprising:

a spring mounted to said first and second members to provide a longitudinally directed biasing force for biasing said first and second members towards one of said first or second positions.

11. The assembly of claim 1, wherein said second flow path further comprises:

at least one port for laterally directed flow to said annulus.

12. The assembly of claim 1, wherein:

said first and second members are tubular and telescopingly arranged with respect to each other.

13. An assembly for use in a wellbore, said wellbore having a hydraulic artificial lift device therein for pumping a well fluid out of a reservoir portion of said wellbore, said reservoir having a reservoir pressure, an outer tubular member being in said wellbore and an inner tubing being within said outer tubular member to form an annulus therebetween, said annulus having an annular pressure, a reservoir connection being secured within said wellbore and having an inner diameter, a one-way valve for permitting said well fluid to flow out one-way of said reservoir to said hydraulic artificial lift device when said one-way valve is open, said assembly comprising:

a tubular member disposed at a furthermost end of said assembly, said tubular member having an outer diameter smaller than said inner diameter of said reservoir connection and being extendable into said reservoir connection, said tubular member defining therein a flow path to permit said well fluid to flow from said reservoir portion of said wellbore to said one-way valve and, when said one-way valve is in said open position, to said hydraulic artificial lift device; and a tubular sealing section adjacent said tubular member for sealing with said reservoir connection, sold assembly having a hydraulic latch with no radially extendable/retractable mechanical latches and being securable in position by a hydraulic force arising from a pressure differential between said annular pressure and said reservoir pressure.

14. The assembly of claim 13, wherein:

said tabular sealing section comprises a malleable metal for forming a metal-to-metal seal with said reservoir connection.

15. The assembly of claim 13, wherein said tubular sealing section comprises:

a conical portion.

16. The assembly of claim 13, further comprising:

said tubular sealing section has an elastomeric seal for sealing with said reservoir connection.

17. The assembly of claim 13, further comprising:

a metal-to-metal seal, and a metal-to-elastomeric seal.

18. The assembly of claim 13, wherein said tubular sealing section further comprising:

a malleable metal portion, and an elastomeric seal element positioned within said malleable metal portion.

19. The assembly of claim 13, wherein:

said tubular member has an outer diameter slightly smaller than said inner diameter of said reservoir connection for a sliding fit therein.

20. An assembly for use in a wellbore having a reservoir portion with a reservoir pressure, said wellbore having therein an outer tubular member and an inner tubular member such that an annulus is formed therebetween, said annulus having an annular pressure, a valve in said wellbore for controlling flow of a well fluid from said reservoir portion, said valve having an open and a closed position, said assembly comprising:

first and second members being securable to said inner tubular member and being disposed within said outer tubular member, said first and second members being relatively moveable with respect to each other between a first position and a second position in response to longitudinal movement of said inner tubular member, said first and second members defining therein a flow path to permit said well fluid to flow from said reservoir portion of said wellbore; and a seal positioned between said first and second members to seal off communication between said flow path and said annular pressure when said first and second members are in said first position and when said valve is in said closed position, said first and second members being profiled to permit communication past said seal and between said flow path and said annular pressure when said first and second members are in said second position.

21. The assembly of claim 20, further comprising:

at least one of said first or second members supporting said valve therein, said second member being in surrounding relationship to said first member, at least one of said first and second members defining a second flow path extending longitudinally across said valve for said permitting of communication past said seal to thereby equalize pressure across said valve when said first and second members are in said second position.

22. The assembly of claim 21, wherein:

said second flow path is blocked from equalizing pressure across said valve when said first and second members are in said first position.

23. A method for providing hydraulic artificial lift installation for a wellbore having a reservoir portion therein for producing a well fluid and a reservoir connection fastened within said wellbore for securing said coil tubing hydraulic artificial lift installation within said wellbore, said coil tubing hydraulic artificial lift installation being suitable for connection with a coil tubing string, said wellbore having an outer tubular mounted therein in surrounding relationship to said coil tubing to form an annulus therebetween, said method comprising:

providing a first member having a one-way valve therein for controlling flow of a wellbore fluid to said coil tubing hydraulic artificial lift, said first member having therein a flow path for flow of said wellbore fluid from said reservoir through said one-way valve when said one-way valve is open and then to said coil tubing sting such that closure of said one-way valve produces a differential pressure acting on said one-way valve with a higher pressure on one side of said valve;

providing a second member mounted to said first member for movement in a limited range with respect to said first member to form a respective first position and a respective second position;

providing a seal between said first and second members to seal off communication between said flow path and said higher pressure when said first and second members are in said first position and said one-way valve is closed, said first and second members being fashioned to open a second flow path to allow communication between said first flow path and said higher pressure when said one-way valve is closed.

24. The method of claim 23, further comprising:

providing at least one of said first and second members to be suitable for removable fastening with respect to said reservoir connection.

25. The method of claim 23, wherein:

at least one of said first and second members define said second flow path therebetween such that said second flow path extends across said one-way valve so as to equalize said differential pressure across said one-way valve when said one-way valve is closed and said first and second members are in said second position.

26. The method of claim 23, wherein:

at least one of said first and second members define said second flow path such that said second flow path is in communication with said annulus when said one-way valve is closed and said first and second members are in said second position.

27. The method of claim 23, further comprising:

moving said first and second members to said second position, and pumping a well treatment fluid into said reservoir portion via said second flow path.

28. A method for a hydraulic latch used with a coil tubing hydraulic lift assembly within a wellbore having a reservoir connection sealingly mounted within said wellbore and in communication with a reservoir having a reservoir pressure, said wellbore having therein a hydrostatic pressure, said method comprising:

fixably securing an elongate guide member to said coil tubing hydraulic lift assembly for guiding insertion into said reservoir connection such that said elongate guide member is extendable substantially through said reservoir connection;

providing said guide member with a sealable reservoir fluid flow path such that said guide aligns a sealing section with said reservoir connection for sealing between said reservoir connection and said reservoir fluid flow path; and providing said coil tubing hydraulic lift assembly with a one-way valve therein to create a differential pressure between said hydrostatic pressure and said reservoir pressure for hydraulically securing said guide member and said coil tubing hydraulic lift assembly within said wellbore to said reservoir connection.

29. The method of claim 28, further comprising:

providing said sealing section of a malleable material.

30. The method of claim 28, further comprising:

providing no radially moving mechanical latches for use in securing said coil tubing hydraulic artificial lift assembly to said reservoir connection.

31. The method of claim 28, further comprising:

providing first and second members moveable between an open position wherein flow occurs around said one-way valve when said one-way valve is closed and a closed position wherein flow does not occur around said one-way valve when said one-way valve is closed, moving said first and second members to said open position, and pumping a fluid into said reservoir portion.

32. An artificial hydraulic lift bottomhole assembly for use in a wellbore having a reservoir portion with a reservoir pressure and having therein a well fluid, said wellbore having therein an outer tubular member and an inner tubular member with an annulus formed therebetween, a reservoir connection secured to said outer tubular member in communication with said reservoir portion and said reservoir pressure, said annulus having an annular pressure, said assembly comprising:

first and second members being securable to said inner tubular member and being disposed within said outer tubular member, said first and second members being relatively longitudinally moveable with respect to each other between a first relative longitudinal position and a second relative longitudinal position in response to longitudinal movement of said inner tubular member, said first and second members defining therein a first flow path to permit said well fluid to flow from said reservoir portion of said wellbore through said first and second members;

respective sets of upper and lower stop elements for limiting longitudinal movement of said first and second members to said first relative longitudinal position and said second relative longitudinal position;

a one-way valve secured to at least one of said first and second members for controlling flow of said well fluid from said reservoir portion, said one-way valve having an open and it closed position; and a connection member for connecting at least one of said first and second members to said reservoir connection.

33. The artificial hydraulic lift bottomhole assembly of claim 32, further comprising:

a seal positioned between said first and second members to seal oft communication between said flow path and said annular pressure when said first and second members are in said first relative longitudinal position and when said one-way valve is in said closed position, said first and second members being profiled to permit communication past said seal and between said flow path and said annular pressure when said first and second members are in said second relative longitudinal position.

34. The artificial hydraulic lift bottomhole assembly of claim 32, further comprising:

at least one of said first or second members supporting said one-way valve therein, said second member being in surrounding relationship to said first member, at least one or said first and second members defining a second flow path extending longitudinally across said one-way valve when said first and second members are in said second relative longitudinal position for permitting communication past said one-way valve when said one-way valve is in said closed position to thereby equalize pressure across said one-way valve.

35. The artificial hydraulic lift bottomhole assembly of claim 34, wherein said second flow path is blocked from equalizing pressure across said valve when said first and second members are in said first relative longitudinal position.

36. The artificial hydraulic lift bottomhole assembly of claim 32, further comprising:

a tubular sealing section adjacent said connection member for sealing with reservoir connection, said connection member and said tubular sealing section forming a hydraulic latch with no radially extendable/retractable mechanical latching members and being securable in position by a hydraulic force arising from a pressure differential between sail annular pressure and said reservoir pressure.

* * * * *

UNITED STATES PATENT AND TRADEMARK OFFICE

CERTIFICATE OF CORRECTION

PATENT NO. : 6,050,340

DATED : April 18, 2000

INVENTOR(S) : Matthew T. Scott

It is certified that error appears in the above-identified patent and that said Letters Patent is hereby corrected as shown below:

In column 16, line 52, delete "sold" and insert therefor --said--
In column 16, line 59, delete "tabular" and insert therefor --tubular--
In column 17, line 55, after "providing" insert --a coil tubing--
In column 19, line 41 delete "it" and insert therefor --a--
In column 20, line 6, delete "oft " and insert therefor --off--
In column 20, line 40 delete "sail" and insert therefor --said--

Signed and Sealed this

Twentieth Day of March, 2001

*Attest:*

Nicholas P. Godici

NICHOLAS P. GODICI

*Attesting Officer*

*Acting Director of the United States Patent and Trademark Office*